US008830139B2

(12) United States Patent
Chang

(10) Patent No.: US 8,830,139 B2
(45) Date of Patent: Sep. 9, 2014

(54) INTEGRATED WINDOW FOR A CONFORMAL HYBRID EO/RF APERTURE

(75) Inventor: Yueh-Chi Chang, Northborough, MA (US)

(73) Assignee: Raytheon Company, Waltham, MA (US)

( * ) Notice: Subject to any disclaimer, the term of this patent is extended or adjusted under 35 U.S.C. 154(b) by 632 days.

(21) Appl. No.: 13/191,596

(22) Filed: Jul. 27, 2011

(65) Prior Publication Data

US 2012/0038539 A1 Feb. 16, 2012

Related U.S. Application Data

(60) Provisional application No. 61/373,302, filed on Aug. 13, 2010.

(51) Int. Cl.

| | |
|---|---|
| ***H01Q 1/42*** | (2006.01) |
| ***H01Q 1/28*** | (2006.01) |
| ***H01Q 5/00*** | (2006.01) |

(52) U.S. Cl.

CPC ..... *H01Q 1/422* (2013.01); *H01Q 1/286* (2013.01); *H01Q 5/0013* (2013.01)

USPC ..... 343/872

(58) Field of Classification Search

CPC ..... H01Q 1/42; H01Q 1/422; H01Q 1/286

USPC ..... 343/705, 872

See application file for complete search history.

(56) References Cited

U.S. PATENT DOCUMENTS

| | | | | |
|---|---|---|---|---|
| 4,353,769 | A | 10/1982 | Lee | |
| 5,126,869 | A | 6/1992 | Lipchak et al. | |
| 5,182,564 | A * | 1/1993 | Burkett et al. | 342/53 |
| 5,268,680 | A | 12/1993 | Zantos | |
| 6,060,703 | A * | 5/2000 | Andressen | 250/203.6 |
| 6,816,112 | B1 * | 11/2004 | Chethik | 342/357.31 |
| 6,919,854 | B2 | 7/2005 | Milroy et al. | |
| 7,068,235 | B2 | 6/2006 | Guidon et al. | |
| 7,109,935 | B2 | 9/2006 | Saint Clair et al. | |
| 7,205,948 | B2 | 4/2007 | Krikorian et al. | |
| 7,388,551 | B2 | 6/2008 | Guidon et al. | |
| 7,656,345 | B2 | 2/2010 | Paschen et al. | |
| 8,354,953 | B2 * | 1/2013 | Williams | 342/62 |
| 8,581,775 | B2 * | 11/2013 | Williams | 342/62 |
| 2004/0233117 | A1 | 11/2004 | Milroy et al. | |
| 2006/0017638 | A1 | 1/2006 | Guidon et al. | |
| 2006/0033663 | A1 | 2/2006 | Saint Clair et al. | |
| 2006/0274987 | A1 | 12/2006 | Mony et al. | |
| 2009/0146896 | A1 | 6/2009 | Guidon et al. | |
| 2011/0256329 | A1 * | 10/2011 | Thomas et al. | 428/34.6 |

OTHER PUBLICATIONS

Office Action dated Feb. 12, 2014 for U.S. Appl. No. 13/206,978 12 pages.

PCT Search Report of the ISA for PCT/US2011/047515 dated Apr. 27, 2012.

(Continued)

*Primary Examiner* — Tan Ho

(74) *Attorney, Agent, or Firm* — Daly, Crowley, Mofford & Durkee, LLP

(57) ABSTRACT

An integrated radio frequency (RF)/optical window includes an RF radome portion provided from a composite material substantially transparent to RF energy disposed about an optical window configured for use with an optical phased array.

20 Claims, 3 Drawing Sheets

(56) References Cited

OTHER PUBLICATIONS

Written Opinion of the ISA for PCT/US2011/047515 dated Apr. 27, 2012.
International Preliminary Report on Patentability for PCT/US2011/047515 dated Aug. 13, 2010.
Notification Concerning Transmittal of International Preliminary Report on Patentability (Chapter 1 of the Patent Cooperation Treaty), PCT/US2011/047514, dated Sep. 26, 2013, 1 page.
International Preliminary Report on Patentability, PCT/US2011/047514, dated Sep. 17, 2013, 1 page.
Written Opinion of the International Searching Authority, PCT/US2011/047514, dated Aug. 20, 2013, 7 pages.
Brookner; "Phased Arrays Around the World—Progress and Future Trends;" IEEE 2003 International Symposium on Phased Array Systems and Technology; Oct. 14-17, 2003; pp. 1-8.
International Search Report of the ISA for PCT/US2011/047514 dated Aug. 20, 2013.
Written Opinion of the ISA for PCT/US2011/047514 dated Aug. 20, 2013.
DesAutels et al.; "Research and Development of an Integrated Electro-Optical and Radio Frequency Aperture;" Oct. 14, 2003; pp. 1-9.
Raytheon Company; "VICTS Antenna;" data sheet; www.raytheon.com/capabilities/products/victs/; printed Jul. 30, 2010; 3 sheets.
"Schafer Lightweight Optical Systems (LWOS)"; www.nmoia.org/images/Schafer_lwos_brochure; Aug. 1, 2010; pp. 1-28.
Sikina et al.; "Variably Inclined Continuous Transverse Stub-2 Antenna;" 2003 IEEE International Symposium on Phased Array Systems and Technology; Oct. 14-17, 2003; pp. 435-440.
Thinkom Solutions, Inc.; The Variable Inclination Continuous Transverse Stub (VICTS) Array; data sheet; www.thin-kom.com/pdf/NonPropVICTSWP; Aug. 1, 2010; 2 sheets.

* cited by examiner

INTEGRATED WINDOW FOR A CONFORMAL HYBRID EO/RF APERTURE

CROSS REFERENCE TO RELATED APPLICATION

This application claims the benefit of U.S. Provisional Application No. 61/373,302 filed Aug. 13, 2010 under 35 U.S.C. §119(e) which application is hereby incorporated herein by reference in its entirety.

FIELD OF THE INVENTION

The system and techniques described herein relate generally to antennas, radomes, optical phased arrays, and more particularly to a conformal hybrid electro-optical/radio frequency (EO/RF) window.

BACKGROUND OF THE INVENTION

As is known in the art, there is a need for transferring relatively large amounts of data (e.g. greater than 1 Gb/sec) between satellite/sensors, unmanned aerial vehicle (UAVs), aircrafts, ships and ground stations. Potential applications include airborne networking backbone for GIG extension and US Navy high data rate reach-back for military, downloading of satellite gathered data for NASA/NOAA, and border monitoring or disaster recovery communications for homeland security.

To satisfy the requirements of such disparate applications, it is necessary to have a hybrid elctro-optical/radio frequency (EO/RF) aperture (HERA) that combines an electro-optic (EO) phased array and RF antenna in a common aperture. This approach saves real estate and simplifies pointing and tracking algorithms. Furthermore, it is desirable for the EO/RF aperture to be conformal to a fuselage of an aircraft, UAV or other body. In aircraft applications, conformal apertures reduce drag and volume.

Prior attempts to provide a HERA include systems such as that manufactured by Mission Research Corporation (MRC). The MRC approach comprises an RF horn antenna having an optical beam disposed through a sidewall of the horn. Such a system can provide a common mechanical motion for both EO and RF that are co-boresight. Another prior art system manufactured by Schaeffer includes a 50 cm optical telescope disposed on a reflector of a Global Hawk Ku-band communications reflector antenna. This approach also provides a common mechanical motion for both EO and RF that are co-boresight. Both of the above systems have common EO/RF apertures. Neither system, however, is conformal to a surface on which they are disposed and both systems require significant volume.

It would, therefore, be desirable to provide to a conformal, a hybrid electro-optic/radio frequency (EO/RF) system having a common RF/EO aperture and which requires a relatively small volume.

SUMMARY OF THE INVENTION

In accordance with the concepts, systems and techniques described herein, an integrated window includes a radio frequency (RF) radome portion provided from a composite material transparent to radio frequency (RF) signals and an optical window portion provided from an optically transparent material embedded within the RF radome portion.

With this particular arrangement, an integrated window which is transparent to both RF and optical signals is provided. In one embodiment, the RF radome portion is symmetrically disposed about the optical window. In one embodiment, the RF radome portion and optical window portion are provided having generally circular shapes and the RF window portion is concentrically disposed about the optical window portion. In one embodiment, the RF radome portion is provided from a curved composite material transparent to RF signals. In one embodiment, the composite material is provided from a mix of epoxy/quartz and epoxy/fiberglass. In one embodiment, an environmental coating (e.g. a layer of paint) is disposed on an external surface of the RF radome portion to provide environmental protection. In one embodiment, the optical window portion is provided from an optically transparent window embedded in the RF radome. In one embodiment the optical window is provided as a flat, fused silica window. In other embodiments, the window may be provided from other optically transparent materials including, but not limited to, sapphire, quartz, silicon, inorganic compounds such as magnesium fluoride (MgF2) or calcium fluoride (CaF2) or semiconductors such as silicon (Si) or from a group II-VI semiconductor such as zinc selenide (ZnSe). The integrated RF radome and optical window improves, and in some cases even optimizes, electro-optical (EO) and RF performance of a HERA while also making it possible for the HERA to be conformal to a body such as the fuselage of an aircraft, an unmanned aerial vehicle (UAV), a ship or a ground based station or other ground-based, air-based or water-based body. Each of the above embodiments may be combined in any manner to provide a variety of other embodiments.

For cost considerations, in one embodiment, the optical window portion of the integrated window can be provided as a relatively small, flat, window which is appropriately polished for optical communications. The thickness of the optical window is selected to provide acceptable, and in some cases optimized, RF performance within a desired RF band while still providing the integrated window having a desired structural strength.

In one embodiment, the RF radome portion of the integrated window is made of a mix of epoxy/quartz and epoxy/fiberglass composite material having an environmental coating (e.g. a layer of paint or other coating) disposed thereover for environmental protection. Solid laminate construction provides the structural strength needed and the use of composite material allows the integrated window to have a curved geometry which allows the integrated window to be conformal to an aircraft fuselage (or other aircraft portion), a UAV fuselage (or other UAV portion), a ship or a ground based station or other ground-based, air-based or water-based body.

The material is selected such that the RF radome and the optical window have the same physical thickness as well as the same electrical wavelengths at a desired RF band. This approach reduces, and in some cases may even minimize insertion loss and phase distortion to achieve substantially optimal RF performance which is particularly important when an RF beam is scanned to a direction where the RF beam passes through both the RF radome portion and optical window portion of the integrated window.

Furthermore, the integrated window includes a region in which the optical window and RF radome are joined together. To provide a relatively smooth mechanical and electrical interface in the joining region, one or more plies of a pre-integrated (prepreg) epoxy/quartz material are disposed on each side of a portion of the optical window. Thus, in the joining region, the prepreg material overlaps both a portion of the optical window and the RF radome to form a sandwich configuration with the optical window. The optical core is provided having a reduced thickness in the joining (or overlap) region such that when the pre-preg material is disposed over the optical window in the overlap regions, the overall thickness of the integrated window is substantially the same in the joining region as the other regions of the integrated window.

In one embodiment, the joining region is provided as a 0.25 inch wide ring along the outside edge of the optical window to thus form an embedded ring. This approach provides a technique to transition between the RF radome portion and the optical window portion and facilitates manufacturing of the integrated window. In one embodiment, the optical window is provided as a fused silica.

With the above embedded ring approach, an integrated conformal RF radome and optical window can be provided having a desired physical and electrical thicknesses. This can be achieved by appropriately utilizing two composite materials with a first one of the materials having a relative dielectric constant which is lower than the relative dielectric constant of the optical window and a second one of the materials having a relative dielectric constant which is higher than the relative dielectric constant of the optical window.

In one embodiment in which the optical window is provided from fused silica, (which has the relative dielectric constant of 3.8), the first material may be provided as epoxy/quartz (which has relative dielectric constant of 3.45, lower than fused silica), and the second material may be provided as epoxy fiberglass (which has a relative dielectric constant of 4.4, higher than fused silica). By utilizing the first and second materials, this technique results in a transition region between the RF radome and optical window which substantially maintains the same physical and electrical thickness and allows the optical window to be embedded in the RF radome.

In one embodiment in which the optical window and RF radome are utilized with an optical phased array (OPA) and an RF antenna and the optical window is provided having a size which is larger than the size of the OPA.

In one embodiment the optical window is provided from one or more of: fused silica; sapphire; quartz; and silicon (Si). In one embodiment the optical window is provided from an inorganic compound such as magnesium fluoride (MgF2) or calcium fluoride (CaF2). In one embodiment the optical window may be provided from a semiconductor such as silicon (Si) or from a group II-VI semiconductor such as zinc selenide (ZnSe).

In one embodiment in which the RF radome is provided from combination of any two types of composite material, with one type with higher dielectric constant than the optical window, (such as epoxy/fiberglass, polyester/fiberglass, cyanate ester/fiberglass,) and the other type with lower dielectric constant than the optical window (such as epoxy/quartz, polyester/quartz, polyester/Kevlar, Cyanate/quartz)

In one embodiment for a system operating in the RF frequency range of 14.4-15.4 GHz, the integrated window is provided having a thickness of about 0.215 inch.

In one embodiment, the optical window is provided from fused silica the RF radome is provided from a mix of epoxy/quartz and epoxy/fiberglass composite material.

In one embodiment, an environmental coating (e.g. a layer of paint or other suitable material) is disposed on an exposed surface of the integrated window to provide environmental protection.

In one embodiment, the integrated window is provided from solid laminate construction and is provided having a curved shape conformal to a surface of a body such as an aircraft fuselage (or other aircraft portion), a surface (or other portion) of an unmanned aerial vehicle (UAV), a portion of a ship or a ground based station or other ground-based, air-based or water-based body.

In one embodiment, the optical window is appropriately polished for optical communications.

DETAILED DESCRIPTION OF THE PREFERRED EMBODIMENTS

Figure 1:
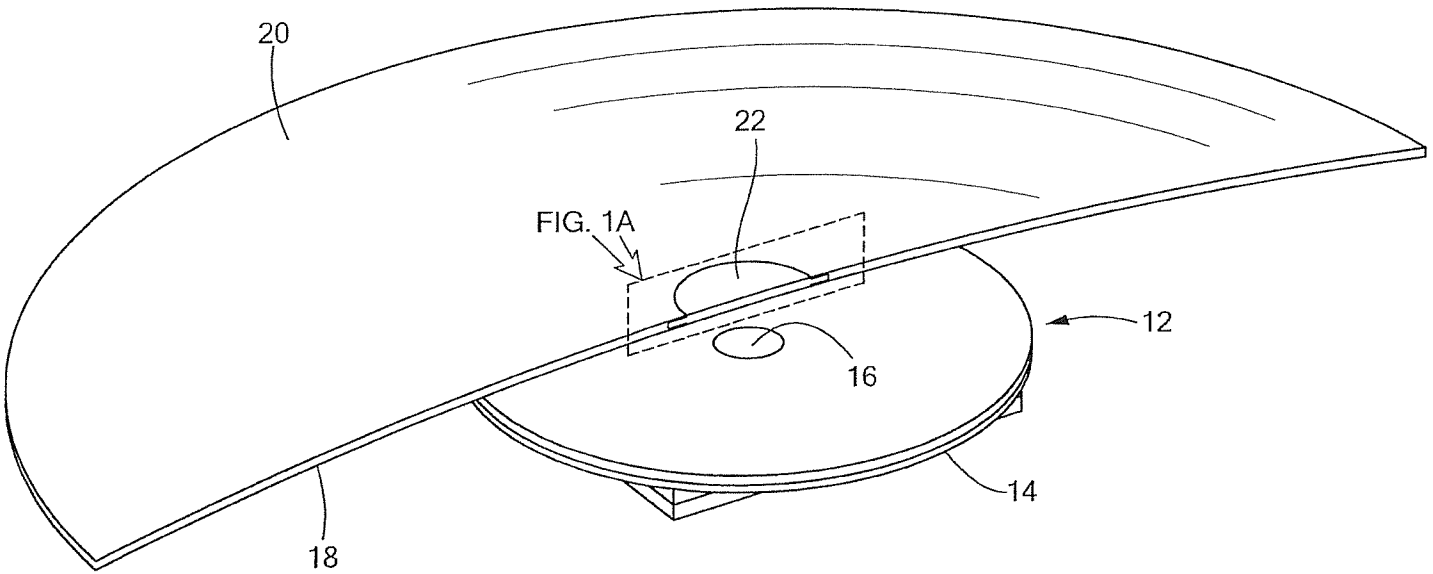
FIG. 1 is an isometric view of a portion of a conformal hybrid electroptic/radio frequency (EO/RF) aperture having a radio frequency (RE) portion and an integrated-optical window portion.
Figure 1A:
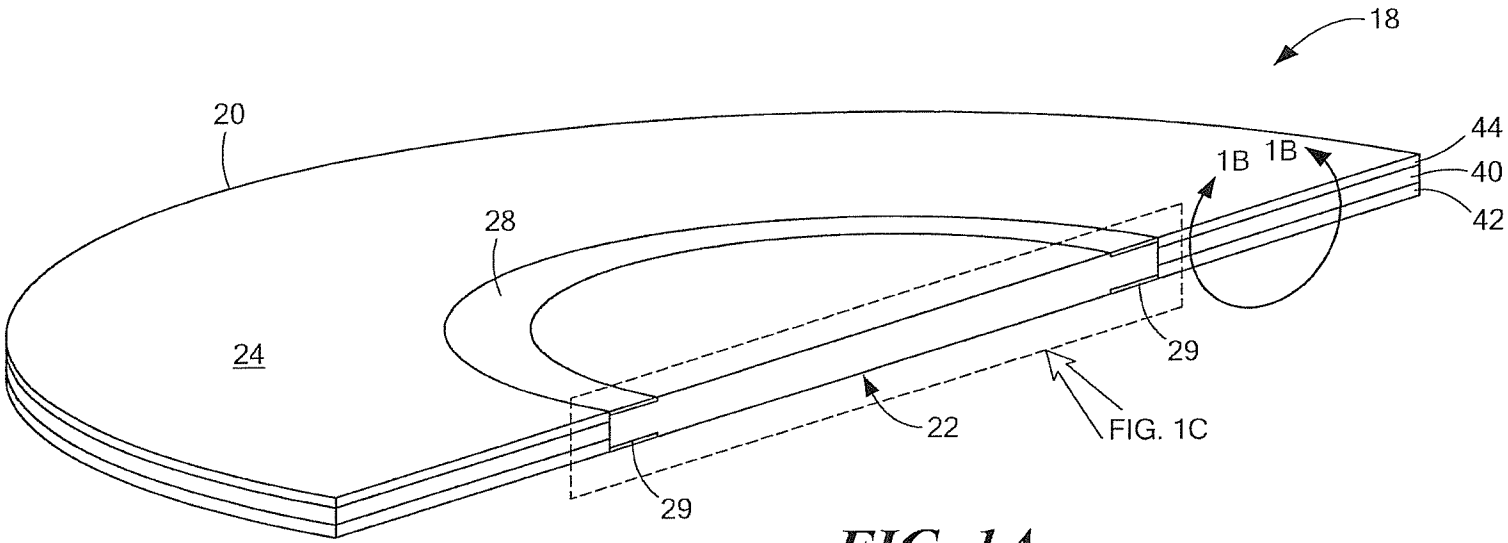
FIG. 1A is an expanded isometric view of an integrated window having an RF radome portion and an optical window portion taken along lines 1A-1A of FIG. 1.
Figure 1B:
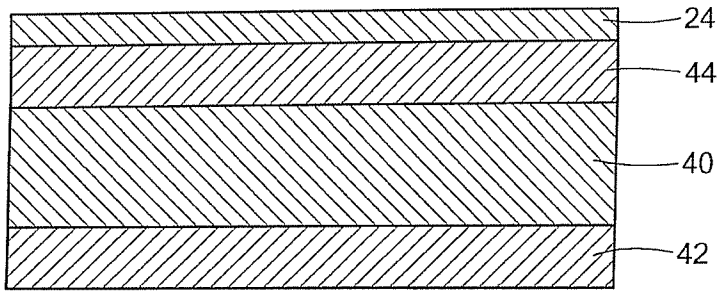
FIG. 1B is an expanded cross-sectional view of an integrated window taken along lines 1B-1B of FIG. 1A.

Referring now to FIGS. 1-1B, in which like elements are provided having like reference designations throughout the several views, a conformal hybrid electro-optic/radio frequency aperture (HERA) 12 has an integrated window 18 disposed thereover. Integrated window 18 includes an RF radome portion 20 and an optical window portion 22. The thickness of RF radome portion 20 is selected to be substantially the same as the thickness of the optical window portion 22, which was chosen to optimize the RF performance. Also, the radome is provided having a thickness such that it can meet vibration and other environmental and mechanical requirements. Thus, in practical applications, a minimal thickness of integrated window 18 is determined by a number of factors including, but not limited to, the ability to withstand an environment to which the integrated window 18 will be exposed.

In the exemplary embodiment shown in FIG. 1, hybrid electro-optic/radio frequency (EO/RF) aperture 12 is provided from a variable inclination continuous transverse stub (VICTS) antenna 14 having an aperture in a central portion thereof in which is disposed an optical phased array (OPA) 16.

Integrated window 18 includes RF radome portion 20 provided from material that is suitable (i.e. electrically transparent) to a range of radio frequency (RF) signals of interest and optical window portion 22 embedded within the RF radome portion, with the optical window portion being provided from an optically transparent material. Thus, integrated window 18 is transparent to both RF and optical signals.

Figure 1C:
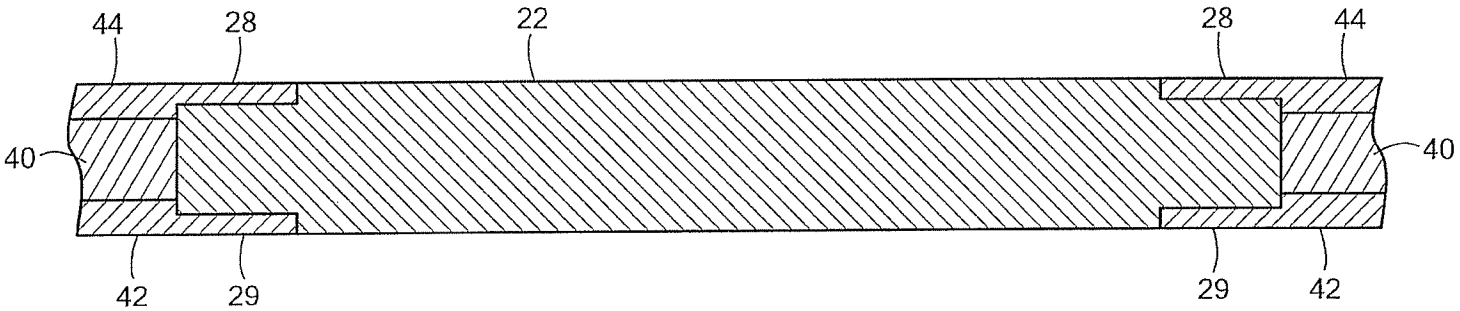
FIG. 1C is an expanded cross-sectional view of an integrated window taken along lines 1C-1C of FIG. 1A.

In one embodiment, RF radome portion 20 corresponds to an RF radome provided from a composite material which is substantially transparent to signals in a desired range of RF frequencies. In one embodiment, the composite material is provided from a mix of epoxy/quartz and epoxy/fiberglass. In the embodiment shown in FIGS. 1 and 1B, an environmental coating 24 (e.g. a layer of paint or other suitable coating) is disposed on an external surface of RF radome portion 20 to provide environmental protection. It should be noted that environmental coating 24 layer is typically relatively thin (e.g. on the order of 0.002" to 0.005"), and thus, to promote clarity in the drawings, is not shown in FIGS. 1A and 1C.

In the embodiment shown in FIGS. 1 and 1A, optical window portion 22 is provided as a substantially flat, fused silica window 22 embedded in the RF radome 20. By making RF radome portion 20 from a composite material, the RF radome portion can be provided (but need not be provided) having a curved surface. Thus, the RF radome portion can be used in applications which require a curved surface or in applications which require a substantially flat surface.

The curved radome surface can be provided using one of a plurality of different techniques including, but not limited to; laying up using pre-preg layers; molding; machining; or forming. Thus, the integrated window can be provided having a shape which matches the shape of a flat or a curved surface (i.e. a so-called conformal shape).

Furthermore, the integrated window 18 improves, and in some cases even optimizes, electro-optical (EO) and RF performance of a HERA while also making it possible for the HERA to be conformal to a body such as the fuselage (or other portion) of an aircraft, an unmanned aerial vehicle (UAV), a ship or a ground based station or other ground-based, air-based or water-based body or other structure or body.

For cost considerations, in some embodiments, the optical window portion of the integrated window can be provided as a relatively small, flat, window which is appropriately polished for optical communications. The thickness of the optical window is selected to provide acceptable, and in some cases optimized, RF performance within a desired RF band while still providing the integrated window having a desired structural strength.

Referring briefly to FIG. 1B, the RF radome portion 20 of integrated window 18 may be made of a mix of epoxy/quartz 42, 44 disposed on either side of an epoxy/fiberglass 40 to provide a composite material. An environmental coating layer 24 (e.g. a layer of paint or other suitable material) is disposed on an outside surface of epoxy/quartz layer 44 for environmental protection. Solid laminate construction provides the structural strength required by the integrated window and the use of composite material allows the integrated window to have a curved geometry. This allows the integrated window to be conformal to an aircraft fuselage (or other aircraft portion) or UAV fuselage (or other UAV portion).

The materials from which integrated window 18 is provided are selected such that the RF radome 20 and the optical window 22 have substantially the same physical thickness as well as substantially the same electrical wavelengths at a desired RF band. This approach reduces, and in some cases may even minimize, insertion loss and phase distortion of RF signals and allows the HERA 12 to achieve substantially optimal RF performance, especially when an RF beam (e.g. provided by a VICTS antenna) is scanned to a direction where the RF beam passes through both RE radome 20 and optical window 22.

The integrated window 18 also includes areas 28, 29 (FIG. 1A) on first and second opposing surfaces of optical window 22 in which an overlap of optical window 22 and RF radome 20 exists. Areas 28, 29 correspond to joining regions (i.e. regions of integrated window 18 in which RF radome 20 and optical window 22 are physically joined.

In one exemplary embodiment, the thickness of optical window 22 is reduced (e.g. by a machining operation, for example) by an amount approximately equal to two (2) to four (4) plies of an epoxy/quartz prepreg material. In one embodiment each ply is in the range of about 5-15 mils with plies in the range of 10-11 mils being preferred for operation in the RE frequency range of about 14.4-15.4 GHz. The plies of prepreg epoxy/quartz are disposed over portions of optical window 22 to form a sandwich structure with a portion of the optical window (i.e. the portion having a slightly reduced thickness in the overlap region 28) forming the core of the sandwich. To join the RF radome portion and the integrated window one may use a standard composite manufacturing process during which pre-preg layers are cured and glued together in an oven or autoclave by heat and pressure.

In one embodiment, overlap regions 28, 29 are each provided as a 0.25 inch wide ring along the outside edge of the optical window 22. This approach provides a technique to transition between the RF radome portion 20 and the optical window portion 22 and facilitates manufacturing of the integrated window 18.

With the above embedded ring approach, an integrated conformal RF radome and optical window can be provided having a desired physical and electrical thicknesses. This can be achieved by properly selecting two composite materials with a first one of the materials having a relative dielectric constant which is lower than the relative dielectric constant of the optical window and a second of the materials having a relative dielectric constant which is higher than the relative dielectric constant of the optical window. In one embodiment in which the optical window is provided from fused silica, the first material may be provided as epoxy/quartz (which has lower dielectric constant lower than fused silica), and the second material may be provided as epoxy fiberglass (which has higher dielectric constant than fused silica) Furthermore, the thickness ($T_L$ for lower dielectric constant $E_L$, and $T_H$ for higher dielectric constant $E_H$) of the composite material need to be derived from the following two linear equations. The first equation is to ensure substantially the same physical thickness and the second equation is to ensure similar electrical thickness from RF performance point of view.

$$T_L+T_H=T_O$$

$$T_L*\eta_L+T_H*\eta_H=T_O*\eta_O$$

where $T_O$ and $E_O$ are the thickness and the dielectric constant of the optical window, respectively, which are pre-determined. $\eta_O$ is the index of refraction of the optical window, which is equal to the square root of the dielectric constant $E_O$. Similarly, $\eta_L$ is equal to the square root of the relative dielectric constant $E_L$, and $\eta_H$ is equal to the square root of the relative dielectric constant $E_H$.

This technique results in a transition between the RF radome and optical window which substantially maintains the same physical and electrical thickness and allows the optical window to be embedded in the RF radome.

Figure 2:
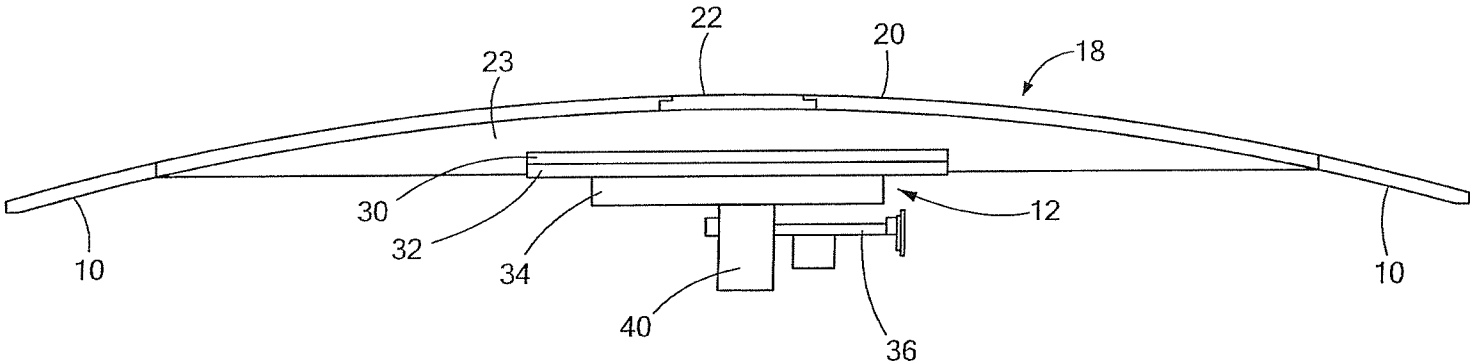
FIG. 2 is a side view of a conformal hybrid EO/RF aperture having an integrated window.

Referring now to FIG. 2 in which like elements of FIGS. 1 and 1A are provided having like reference designations, a body 10 has an opening therein in which is disposed a conformal hybrid electro-optic/radio frequency (EO/RF) aperture (HERA) 12. Hybrid EO/RF aperture 12 is provided from a variable inclination continuous transverse stub (VICTS) antenna 14 having an aperture in a central portion thereof in which is disposed an optical phased array (OPA) 16. A radome 18 is disposed over the VICTS antenna and spaced apart by an air gap 23.

The OPA signal can pass through optical window, but not the RF radome. Stated differently, the optical window is transparent to OPA signals, but the RF radome is not transparent to OPA signals. Note that the OPA aperture is significantly smaller, so the size of the optical window is chosen to cover the maximum scan angle of the OPA plus some margin. On the other hand, this design is such that the RF energy can pass through also the optical window and a joining region between the optical window and RF radome without much discontinuity.

In one exemplary embodiment, VICTS 14 may include a polarizer 30 which is disposed over a first surface of a slot plate 32. Slot plate 32, in turn, is disposed over a CTS subarray 34. A power divider network 36 is coupled to the CTS subarray 34. An OPA 40 is disposed in a central opening provided in polarizer 30, slot plate 32, subarray 34 and power divider 36.

The polarizer and slot plate are coupled to rotate together to scan in elevation. The entire hybrid EO/RF aperture 12 and OPA 40 rotate in azimuth together.

Having described preferred embodiments which serve to illustrate various concepts, structures and techniques which are the subject of this patent, it will now become apparent to those of ordinary skill in the art that other embodiments incorporating these concepts, structures and techniques may be used. Accordingly, it is submitted that that scope of the patent should not be limited to the described embodiments but rather should be limited only by the spirit and scope of the following claims.

What is claimed is:

1. An integrated radio frequency (RF)/optical radome comprising:

an optical window having first and second opposing surfaces, a central region and a perimeter region with the perimeter region being thinner than the central region; and an RF radome portion provided from a composite material transparent to RF energy disposed about said optical window such that portions of said RF radome portion are disposed over and physically joined with the first and second opposing surfaces of said optical window along the perimeter regions of said optical window such that an overlap of said optical window and said RF radome exists.

2. The integrated RF/optical radome of claim 1 wherein said RF radome is provided having a sandwich configuration provided from a core region having first and second opposing surfaces and one or more layers of a composite material disposed over each of the first and second opposing surfaces of said core.

3. The integrated RF/optical radome of claim 2 where said RF radome is provided from two composite materials disposed about the core, with a first one of the materials having a relative dielectric constant which is lower than the relative dielectric constant of said optical window and a second one of the materials having a relative dielectric constant which is higher than the relative dielectric constant of the optical window.

4. The integrated RF/optical radome of claim 3 where the one or more layers disposed on each surface of the core region are provided as two (2) to four (4) plies of an epoxy/quartz prepreg material and the thickness of the perimeter of said optical window is reduced by an amount approximately equal to two (2) to four (4) plies of the epoxy/quartz prepreg material.

5. The integrated RF/optical radome of claim 4 where the plies of prepreg epoxy/quartz are disposed over the perimeter portions of said optical window to form a sandwich structure with the perimeter of the optical window.

6. The integrated RF/optical radome of claim 5 where each ply is has a thickness in the range of about 5-15 mils with plies in the range of 10-11 mils being preferred.

7. The integrated RF/optical radome of claim 2 wherein said RF radome is provided from a solid laminate construction which allows the RF radome to have a curved shape conformal to a surface of a body.

8. The integrated RF/optical radome of claim 1 where said optical window is provided having a circular shape and the overlap region on each surface of said optical window corresponds to a ring along the perimeter of said optical window such that when portions of said RF radome portion are disposed over and physically joined with the first and second opposing surfaces of said optical window the structure corresponds to an embedded ring.

9. The integrated RF/optical radome of claim 1 where said optical window is provided from fused silica, the first material is provided as epoxy/quartz having a lower dielectric constant lower than fused silica, and the second material is provided as epoxy fiberglass having a higher dielectric constant than fused silica.

10. The integrated RF/optical radome of claim 1 where the thickness of said optical window is substantially the same as the thickness of the region of the RF radome in which said optical window is disposed.

11. The integrated RF/optical radome of claim 1 wherein said RF radome portion comprises at least two types of composite material, with one type having a higher dielectric constant than the optical window and the other type having a lower dielectric constant than the optical window.

12. The integrated RF/optical radome of claim 1 wherein said optical window is provided from one or more of: fused silica; sapphire; quartz; silicon; an inorganic compound; magnesium fluoride (MgF2); calcium fluoride (CaF2); a semiconductor material; silicon (Si); a group II-VI semiconductor; zinc selenide (ZnSe).

13. The integrated FT/optical radome of claim 1 wherein said RF radome portion comprises:

a mix of epoxy/quartz and epoxy/fiberglass composite material; and an environmental coating disposed over an exposed surface of said RF radome.

14. The integrated RF/optical radome of claim 1 wherein the RF radome material and optical window material are selected such that the RF radome and the optical window have substantially the same physical thickness and substantially the same electrical wavelengths in an RF band of operation.

15. The integrated RF/optical radome of claim 14 wherein said optical window is provided from fused silica and said RF radome is provided by mixing two composite material including epoxy/quartz and epoxy fiberglass and wherein said overlap area between said RF radome and said optical window maintains substantially the same physical and electrical thickness as other portions of said RF/optical radome.

16. A body having an integrated window coupled to a curved surface thereof, the integrated window comprising:

an RE radome portion provided from a curved composite material substantially transparent to radio frequency (RF) signals and conformal to the curved surface of the body; and an optical window portion embedded within the RF radome portion, the optical window portion provided from an optically transparent material.

17. The integrated window of claim 16 where said RF radome portion and said optical window portion are provided from materials selected such that said RF radome portion and said optical window portion have substantially the same physical thickness and substantially the same electrical wavelengths in an RF band of operation.

18. The integrated window of claim 17 where said RF radome portion comprises:

a core region having first and second opposing surfaces;

one or more layers of a composite material disposed over a first one of the first and second opposing surfaces of said core region; and one or more layers of a composite material disposed over a second one of the first and second opposing surfaces of said core region.

19. The integrated window of claim 18 wherein:

the one or more layers of a composite material disposed over the first one of the first and second opposing surfaces of said core region the first material are provided having a relative dielectric constant which is lower than the relative dielectric constant of said optical window portion; and the one or more layers of a composite material disposed over the second one of the first and second opposing surfaces of said core region the first material are provided having a relative dielectric constant which is higher than the relative dielectric constant of said optical window portion.

20. The integrated window of claim 16 wherein said optical window is adapted for optical communications.

* * * * *